US009842452B2

(12) United States Patent
Yin et al.

(10) Patent No.: US 9,842,452 B2
(45) Date of Patent: Dec. 12, 2017

(54) BANKNOTE JAM DETERMINATION SYSTEM AND METHOD

(71) Applicant: GRG BANKING EQUIPMENT CO., LTD., Guangzhou, Guangdong (CN)

(72) Inventors: Fazhi Yin, Guangdong (CN); Liang Xu, Guangdong (CN); Zhiqiang Sun, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/325,187

(22) PCT Filed: Jul. 1, 2015

(86) PCT No.: PCT/CN2015/083049
§ 371 (c)(1),
(2) Date: Jan. 10, 2017

(87) PCT Pub. No.: WO2016/008365
PCT Pub. Date: Jan. 21, 2016

(65) Prior Publication Data

US 2017/0193732 A1 Jul. 6, 2017

(30) Foreign Application Priority Data

Jul. 16, 2014 (CN) ..... 2014 1 0339527

(51) Int. Cl.
*G07F 7/04* (2006.01)
*G07D 11/00* (2006.01)

(52) U.S. Cl.
CPC .... *G07D 11/0039* (2013.01); *B65H 2511/528* (2013.01); *B65H 2553/00* (2013.01);
(Continued)

(58) Field of Classification Search
CPC ..... G07D 11/0027; G07D 11/0036; G07D 11/0039; G07D 11/0048; G07D 11/0063;
(Continued)

(56) References Cited

U.S. PATENT DOCUMENTS 4,772,781 A 9/1988 Watanabe
5,106,077 A 4/1992 Kawaguchi et al.
(Continued)

FOREIGN PATENT DOCUMENTS

CN 1612173 A 5/2005
CN 1689946 A 11/2005
(Continued)

OTHER PUBLICATIONS

International Search Report for PCT/CN2015/083049, dated Oct. 12, 2015, ISA/CN.
(Continued)

*Primary Examiner* — Jeffrey Shapiro
(74) *Attorney, Agent, or Firm* — U.S. Fairsky LLP; Yue Xu

(57) ABSTRACT

A banknote jam determination system and method, the determination system comprising a sensor unit (101), a banknote information storage unit (102), a banknote jam threshold computing unit (103) and a banknote jam status determination unit (104). The banknote jam threshold computing unit (103) can compute a threshold (M) according to an actual space (S) between the actual length (L) of the banknote and the sensor. The banknote jam status determination unit (104) uses a threshold (M) computed in real time to determine whether a banknote jam occurs, and therefore the banknote jam determination system and method are a dynamic banknote jam determination technique based on a varied threshold (M) of a banknote and a sensor, and can improve measurement precision and ensure reliability.

9 Claims, 6 Drawing Sheets

(52) U.S. Cl.
CPC ..... *B65H 2553/82* (2013.01); *B65H 2601/11* (2013.01); *B65H 2601/255* (2013.01); *B65H 2701/1912* (2013.01)

(58) Field of Classification Search
CPC ..... G07D 11/0066; G07D 11/0093; G07F 19/20; G07F 19/202; G06Q 20/042; G06Q 2301/33; G06Q 2407/30; G06Q 2511/16; G06Q 2511/50; G06Q 2513/512; G06Q 2553/80; G06Q 2553/822; G06Q 2553/00; G06Q 2553/82; B65H 5/00; B65H 7/00; B65H 7/02; B65H 7/08; B65H 7/10; B65H 9/00; B65H 9/004; B65H 2301/33; B65H 2407/33; B65H 2407/30; B65H 2511/16; B65H 2511/50; B65H 2513/50; B65H 2513/512; B65H 2553/80; B65H 2553/822; B65H 2553/00; B65H 2553/82; B65H 2301/4314; B65H 2701/1912; B65H 2307/33; B65H 2511/528; B65H 2601/255; B65H 2601/11; B65H 2553/80; B65H 9/20
USPC ..... 194/206, 207, 200; 209/534; 382/135; 235/379; 271/227, 250, 258.01, 259, 261, 271/265.01, 265.02, 265.03
See application file for complete search history.

(56) References Cited

U.S. PATENT DOCUMENTS

| | | | | |
|---|---|---|---|---|
| 7,296,794 | B2 * | 11/2007 | Shimazaki | B65H 7/18 271/10.03 |
| 7,308,853 | B2 * | 12/2007 | Satoh | B65H 5/062 101/118 |
| 8,411,334 | B2 * | 4/2013 | Ogawa | G07D 7/00 358/474 |
| 8,899,400 | B2 * | 12/2014 | Kwak | G06Q 20/042 194/206 |
| 8,910,771 | B2 * | 12/2014 | Robinson | G07D 11/0018 194/203 |
| 2001/0030100 | A1 | 10/2001 | Negishi | |
| 2004/0251589 | A1 * | 12/2004 | Satoh | B65H 5/062 271/10.01 |
| 2005/0091159 | A1 | 4/2005 | Ichikawa | |
| 2005/0151313 | A1 * | 7/2005 | Shimazaki | B65H 7/18 271/10.01 |
| 2009/0008857 | A1 * | 1/2009 | Robinson | G07D 11/0018 271/3.14 |
| 2010/0091345 | A1 * | 4/2010 | Ogawa | G07D 11/0021 358/474 |
| 2011/0290617 | A1 * | 12/2011 | Kwak | G06Q 20/042 194/334 |
| 2011/0291353 | A1 | 12/2011 | Fujiwara et al. | |
| 2014/0077446 | A1 | 3/2014 | Hongo et al. | |

FOREIGN PATENT DOCUMENTS

| | | | |
|---|---|---|---|
| CN | 101101682 | A | 1/2008 |
| CN | 101105881 | A | 1/2008 |
| CN | 103035063 | A | 4/2013 |
| CN | 103434269 | A | 12/2013 |
| JP | H0954860 | A | 2/1997 |
| JP | H1058730 | A | 3/1998 |
| JP | 2007156542 | A | 6/2007 |
| KR | 20110056945 | A | 5/2011 |
| TW | 201405490 | A | 2/2014 |

OTHER PUBLICATIONS

European Search Report for 15822519.3-1953/3171340 PCT/CN2015/083049, dated Sep. 13, 2017.

* cited by examiner

BANKNOTE JAM DETERMINATION SYSTEM AND METHOD

CROSS REFERENCE OF RELATED APPLICATION

The present disclosure is the national phase of International Application No. PCT/CN2015/083049, titled "BANKNOTE JAM DETERMINATION SYSTEM AND METHOD", and filed on Jul. 1, 2015, which claims the priority to Chinese Patent Application No. 201410339527.7, titled "BANKNOTE JAM DETERMINATION SYSTEM AND METHOD", filed on Jul. 16, 2014 with the State Intellectual Property Office of the People's Republic of China, which is incorporated herein by reference in entirety.

FIELD

The present disclosure relates to a sheet medium conveying status monitoring technology, and in particular to a system and a method for determining a banknote jam in a process of conveying a banknote in an ATM core.

BACKGROUND

In conventional technology, a standard for determining a banknote jam in a process of conveying a banknote usually adopts a fixed threshold. As shown in FIG. 4, FIG. 5 and FIG. 6, in a simplified banknote conveying system, 101 represents a banknote conveying direction, 102 is a banknote conveying passage, 103 and 104 are detection sensors arranged on the banknote conveying passage, and 105 is a banknote being conveyed. S is a distance between sensors 103 and 104, L is a length of the banknote, and D is a distance between a front end of the banknote and the sensor 104. In a method for determining a banknote jam based on a fixed threshold includes, the threshold of banknote jam is K times the length of a longest banknote in a case that the banknote blocks a sensor, where K is a constant, and in a case that the banknote does not block a sensor, the threshold of banknote jam is a distance between two sensors between which the banknote is located, or K times the distance. In a case that a banknote jam occurs on a sensor, the distance D between the front end of the banknote and the sensor 104 is greater than K times the length L of the longest banknote. In a case that a banknote jam occurs between the sensors, the distance D between the front end of the banknote and the sensor 104 is greater than the distance S between the two sensors 103 and 104, or K times the distance S, i.e., 108>K*106. Therefore, in a case that a banknote jam is determined based on a fixed threshold in a process of longitudinally conveying banknotes in a longitudinal recycling system, since the banknotes differ greatly in lengths of longer edges, uncut banknotes may be mistakenly determined as a jammed banknote if the threshold is small, which reduces reliability; and if the method is based on a large fixed threshold in view of compatibility with the longest banknote or uncut banknotes, there may be a lag in determining a banknote jam, measurement accuracy may be reduced, and it is even possible that the passage is jammed or uncut banknotes (two banknotes joined head-to-tail) are mistakenly determined as a jammed banknote, etc.

Therefore, there is a need to provide a method for determining a banknote jam which can ensure reliability and improve measurement accuracy.

SUMMARY

In order to solve the problem that a conventional method for determining a banknote jam has low reliability and low measurement accuracy, a method for determining a banknote jam is provided according to the present disclosure, in which an actually measured length of a banknote is introduced into a system for determining a banknote jam and a threshold for determining a banknote jam is changed in a real-time manner, thereby improving measurement accuracy and ensuring reliability.

A system for determining a banknote jam is further provided according to the present disclosure.

The system for determining a banknote jam according to the present disclosure includes: a sensor unit including multiple sensors arranged on a banknote conveying passage at a predetermined interval in a banknote conveying direction, where each of the multiple sensors is configured to independently detect whether a banknote has arrived or left, collect feature information of the banknote which has arrived, and measure a distance between a front end of the banknote which has arrived and itself until the front end of the banknote reaches a next sensor; a banknote information storage unit configured to store a length L and a serial number N of the banknote in a one-to-one correspondence manner and a distance S between each two adjacent sensors; a banknote jam threshold calculation unit configured to calculate a banknote jam threshold M in a real-time manner, where the banknote jam threshold is M=k*L in a process from the front end of the banknote reaching a sensor to a rear end of the banknote leaving the sensor, the banknote jam threshold is M=k*(S−L)+L in a process from the rear end of the banknote leaving the sensor to the front end of the banknote reaching a next sensor, k is a constant, and S is the distance between the sensor and the sensor next to it; and a banknote jam status determination unit configured to determine whether a distance D between the front end of the current banknote and the current sensor is greater than the current banknote jam threshold M, if so, determine that there is a banknote jam, and if not, determine that there is no banknote jam.

Specifically, the feature information of the banknote collected by the sensor unit includes: the length L of the banknote and the serial number N of the banknote which can be directly identified by the system for determining a banknote jam, and a denomination of the banknote and other image feature information which can not be directly identified by the system for determining a banknote jam.

Preferably, the system for determining a banknote jam further includes a banknote information processing unit configured to convert the denomination of the banknote and other image feature information which can not be directly identified by the system for determining a banknote jam, into the length L of the banknote and the serial number N of the banknote which can be directly identified by the system.

The method for determining a banknote jam according to the present disclosure includes: step 1, arranging multiple sensors on a banknote conveying passage at a predetermined interval in a banknote conveying direction; step 2, detecting independently, by each of the multiple sensors, in a banknote conveying process, an arriving status or a leaving status of a banknote; step 3, determining, by a sensor, whether a banknote has arrived, i.e., determining whether a front end of the banknote triggers the sensor, if so, going to step 4, and if not, returning to step 2, where the sensor is defined as a current sensor; step 4, collecting, by the current sensor, feature information of the banknote, obtaining, by a banknote jam threshold calculation unit, a length L of the banknote from a banknote information storage unit based on the feature information of the banknote, and calculating a banknote jam threshold M based on the length L of the banknote, i.e., M=k*L, where k is a constant; step 5, measuring a distance D between the front end of the banknote and the current sensor; step 6, determining whether the distance D between the front end of the banknote and the current sensor is greater than the banknote jam threshold M, where M=k*L, if so, going to step 13, and if not, going to step 7; step 7, determining, by the current sensor, whether the banknote has left, i.e., determining whether a rear end of the banknote has left the current sensor, if so, going to step 8, and if not, returning to step 5; step 8, obtaining, by the current sensor, a distance S between the current sensor and a next sensor, and calculating, by the banknote jam threshold calculation unit again, the banknote jam threshold M but according to M=k*(S−L)+L, where k is a constant; step 9, measuring the distance D between the front end of the banknote and the current sensor; step 10, determining whether the distance D between the front end of the banknote and the current sensor is greater than the banknote jam threshold M, where M=k*(S−L)+L, if so, going to step 13, and if not, going to step 11; step 11, determining whether the front end of the banknote triggers the sensor next to the current sensor in the banknote conveying direction, if so, going to step 12, and if not, returning to step 9; step 12, determining that the banknote is smoothly conveyed and there is no banknote jam, continuing conveying the banknote, and starting banknote jam determination at the next sensor; step 13, determining that there is a banknote jam, and stopping conveying the banknote; and step 14, ending banknote jam determination at the current sensor. In step 4 and step 8, k is a constant which ranges from 1.1 to 2 and is determined by factors including speed stability of the banknote conveying passage and the length L of the banknote, where the higher the speed stability of the banknote conveying passage is, the smaller k is, and the greater the length L of the banknote is, the smaller k is.

The method for determining a banknote jam is performed at each of the multiple sensors independently.

In addition, in a process of conveying a banknote, the sensors implement the method for determining a banknote jam in turn in the banknote conveying direction, to determine whether the banknote is jammed.

Preferably, in step 6 and step 10, a general formula for determining whether the banknote is jammed is D>M=f(L, S), where D is the distance between the front end of the banknote and the current sensor and changes as the process of conveying the banknote proceeds, M is the threshold for determining a banknote jam, L is the length of the banknote and varies with the type of the banknote, S is the distance between two adjacent sensors and varies with locations of the two adjacent sensors, M is a function of L and S, and a value of M changes along with L and/or S.

The system for determining a banknote jam according to the present disclosure includes the banknote jam threshold calculation unit, which can calculate the threshold based on the actual length of the banknote and the actual distance between the sensors. Therefore, the banknote jam determination unit may determine whether there is a banknote jam based on the threshold which is calculated in a real-time manner. In this way, measurement accuracy can be improved, and reliability can be ensured.

DETAILED DESCRIPTION

The technical solutions in embodiments of the present disclosure are clearly and completely described hereinafter in conjunction with the drawings in the embodiments of the present disclosure. Apparently, the described embodiments are only a few rather than all of the embodiments of the invention. All other embodiments obtained by those skilled in the art based on the embodiments of the present disclosure without any creative efforts fall within the protection scope of the present disclosure.

Figure 1:
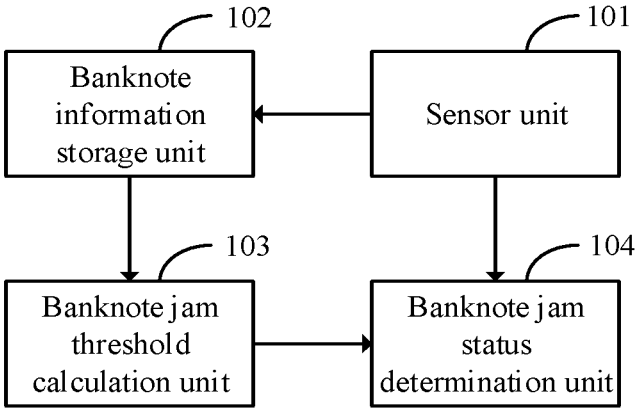
FIG. 1 is a modularized structural diagram of a system for determining a banknote jam according to a first embodiment of the present disclosure.

As shown in FIG. 1, a system for determining a banknote jam is provided, which includes a sensor unit 101, a banknote information storage unit 102, a banknote jam threshold calculation unit 103 and a banknote jam status determination unit 104.

Figure 2:
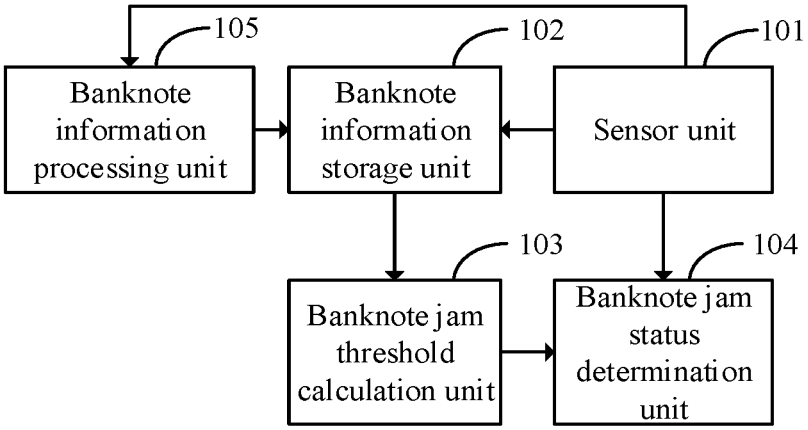
FIG. 2 is a modularized structural diagram of a system for determining a banknote jam according to a second embodiment of the present disclosure.

The sensor unit 101 includes multiple sensors arranged on a banknote conveying passage at a predetermined interval in a banknote conveying direction. Each of the multiple sensors is configured to independently detect whether a banknote has arrived or left, collect feature information of the banknote which has arrived, and measure a distance between a front end of the banknote which has arrived and itself until the front end of the banknote reaches a next sensor. The feature information of the banknote collected by the sensor unit includes a length L of the banknote and a serial number N of the banknote which can be directly identified by the system for determining a banknote jam, and a denomination of the banknote and other image feature information which can not be directly identified by the system for determining a banknote jam. In a case that the feature information of the banknote is not the length of the banknote and the serial number of the banknote, the system for determining a banknote jam further includes a banknote information processing unit 105, as shown in FIG. 2. The banknote information processing unit 105 is configured to convert the feature information of the banknote collected by the sensor unit 101 into the length L of the banknote and the serial number N of the banknote, so as to store the length L of the banknote and the serial number N of the banknote into the banknote information storage unit 102 in a one-to-one correspondence manner.

The banknote information storage unit 102 is configured to store the length L and the serial number N of the banknote in a one-to-one correspondence manner and a distance between two adjacent sensors. The length of the banknote and the serial number of the banknote collected by the sensor unit 101 may be directly stored into the banknote information storage unit 102. In a case that the feature information of the banknote is the denomination or other image feature, the feature information is converted into the length L of the banknote and the serial number N of the banknote after being processed by the banknote information processing unit 105, which are stored into the banknote information storage unit 102 in a one-to-one correspondence manner.

The banknote jam threshold calculation unit 103 is configured to calculate a banknote jam threshold M in a real-time manner. The banknote jam threshold is M=k*L in a process from the front end of the banknote reaching a current sensor to a rear end of the banknote leaving the sensor. The banknote jam threshold is M=k*(S−L)+L in a process from the rear end of the banknote leaving the sensor to the front end of the banknote reaching a next sensor. k is a constant, which generally ranges from 1.1 to 2 and is determined by factors including speed stability of the banknote conveying passage and the length L of the banknote. The higher the speed stability of the banknote conveying passage is, the smaller k is, and the greater the length L of the banknote is, the smaller k is. S is the distance between the sensor and the sensor next to it. The length L of the banknote and the distance S between the two adjacent sensors are obtained by the sensor in a real-time manner and stored into the banknote information storage unit 102. The length L of the banknote and the distance S are then obtained by the banknote jam threshold calculation unit 103 from the banknote information storage unit 102.

It should be noted that, in an actual banknote conveying system, the multiple sensors are arranged in a sequence in the banknote conveying direction, and locations of the sensors are fixed. Hence, the distance S between two adjacent sensors is a fixed value. However, in a process of processing banknote conveying by software, the length L of the banknote and the banknote jam threshold M are measured with a conveying distance of the banknote in a unit time as a measurement unit or directly with a certain displacement as the measurement unit, instead of being measured with an actual unit as a measurement standard. Therefore, in a general situation, in order that maintainability of software is ensured and the measurement unit is changeable for different speeds of the banknote conveying passage, the distance S between two adjacent sensors in the method for determining a banknote jam according to the embodiment needs to be obtained through calculation, instead of being set as an actual fixed value or a calculated fixed value. In the embodiment, the current sensor determines the measurement unit of length based on a real-time speed of the banknote conveying passage, calculates the real-time distance between the current sensor and the next sensor based on serial numbers of the current sensor and the next sensor, and stores the real-time distance into the banknote information storage unit 102. The banknote jam threshold calculation unit 103 obtains the distance S from the banknote information storage unit 102, to calculate the banknote jam threshold in a real-time manner.

The banknote jam status determination unit 104 is configured to determine whether the distance D between the front end of the current banknote and the current sensor is greater than the current banknote jam threshold M, if so, determine that there is a banknote jam, and if not, determine that there is no banknote jam.

Figure 3:
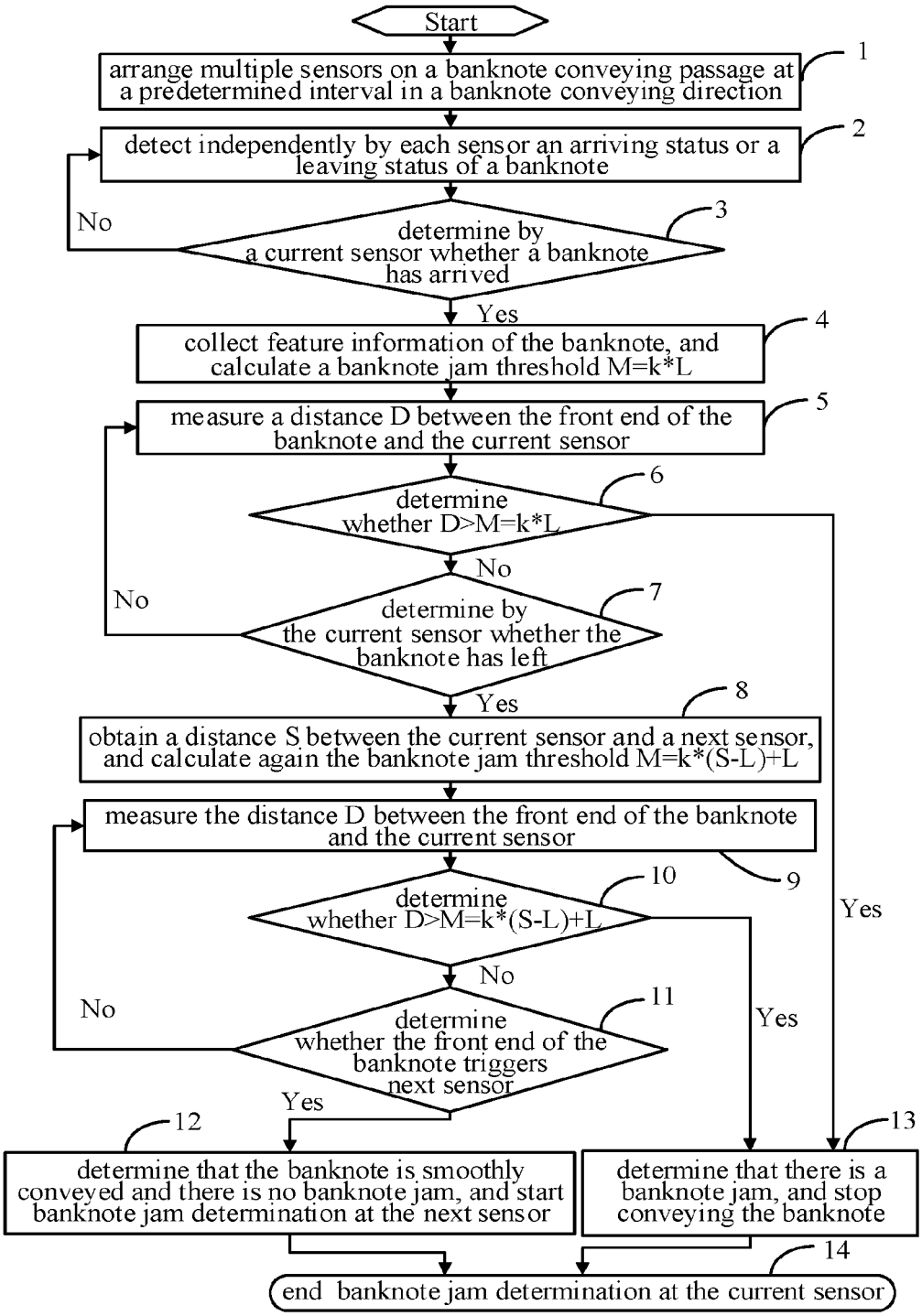
FIG. 3 is a flow chart of a method for determining a banknote jam according to a preferred embodiment of the present disclosure.

In conjunction with FIG. 3, a specific flow of a method for determining a banknote jam according to a preferred embodiment of the present disclosure is described hereinafter. The method for determining a banknote jam includes:

step 1, arranging multiple sensors on a banknote conveying passage at a predetermined interval in a banknote conveying direction;

step 2, detecting independently, by each of the multiple sensors, in a banknote conveying process, an arriving status or a leaving status of a banknote;

step 3, determining, by a sensor, whether a banknote has arrived, i.e., determining whether a front end of the banknote triggers the sensor, if so, going to step 4, and if not, returning to step 2, where the sensor is defined as a current sensor;

step 4, collecting, by the current sensor, feature information of the banknote, obtaining, by a banknote jam threshold calculation unit, a length L of the banknote from a banknote information storage unit based on the feature information of the banknote, and calculating a banknote jam threshold M based on the length L of the banknote, i.e., M=k*L, where k is a constant;

step 5, measuring a distance D between the front end of the banknote and the current sensor;

step 6, determining whether the distance D between the front end of the banknote and the current sensor is greater than the banknote jam threshold M, where M=k*L, if so, going to step 13, and if not, going to step 7;

step 7, determining, by the current sensor, whether the banknote has left, i.e., determining whether a rear end of the banknote has left the current sensor, if so, going to step 8, and if not, returning to step 5;

step 8, obtaining, by the current sensor, a distance S between the current sensor and a next sensor, and calculating, by the banknote jam threshold calculation unit again, the banknote jam threshold M but according to M=k*(S−L)+L, where k is a constant;

step 9, measuring the distance D between the front end of the banknote and the current sensor;

step 10, determining whether the distance D between the front end of the banknote and the current sensor is greater than the banknote jam threshold M, where M=k*(S−L)+L, if so, going to step 13, and if not, going to step 11;

step 11, determining whether the front end of the banknote triggers the sensor next to the current sensor in the banknote conveying direction, if so, going to step 12, and if not, returning to step 9;

step 12, determining that the banknote is smoothly conveyed and there is no banknote jam, continuing conveying the banknote, and starting banknote jam determination at the next sensor;

step 13, determining that there is a banknote jam, and stopping conveying the banknote; and step 14, ending banknote jam determination at the current sensor.

Steps 4 to 7 exactly cover the process from the banknote beginning to trigger the current sensor to the banknote leaving the current sensor, i.e., a process in which the banknote blocks the current sensor. In the process, the banknote jam threshold is M=k*L, until the banknote has left the current sensor before step 8. Steps 8 to 11 exactly cover the process from the banknote leaving the current sensor to the banknote triggering the next sensor, i.e., a process in which the banknote does not block the current sensor. In the process, the banknote jam threshold is M=k*(S−L)+L. Since the length L of the banknote is different for different banknotes and the distance S between adjacent sensors is different for different sensors, the banknote jam threshold M is a dynamic value obtained based on the actually measured length of the banknote and the distance between sensors, which, therefore, results in greater practical significance and improved accuracy and reliability of determination in determining a banknote jam. The banknote jam determination process is described hereinafter with an example in conjunction with FIG. 4 to FIG. 10.

Figure 4:
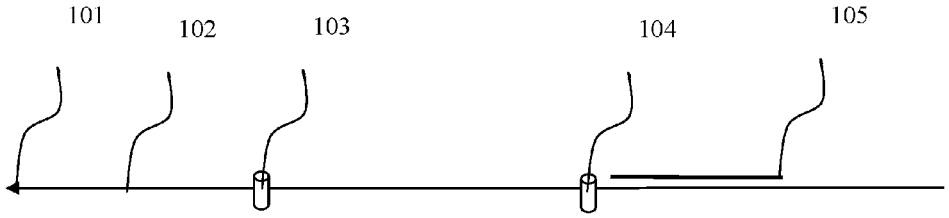
FIG. 4 is a side view of a simplified banknote conveying system.

Reference is made to FIG. 4, which is a schematic diagram of a simplified banknote conveying system. FIG. 4 shows a banknote conveying passage 102, sensors 104 and 103 arranged in a sequence in a banknote conveying direction 101 (illustrated by an arrow), and a banknote 105 being conveyed.

Figure 5:
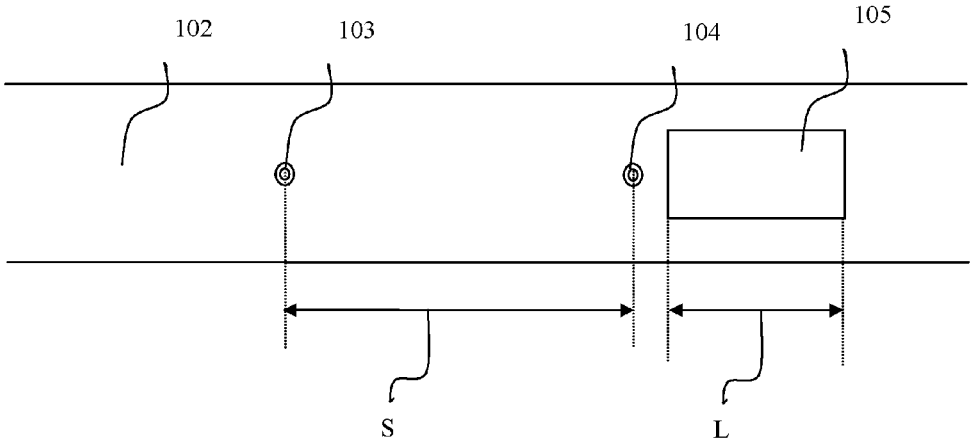
FIG. 5 is a top view of a simplified banknote conveying system.

Reference is made to FIG. 5, which is a top view of the simplified banknote conveying system. FIG. 5 more clearly shows the banknote conveying passage 102, a distance S between the sensors 104 and 103, and a length L of the banknote 105.

Figure 6:
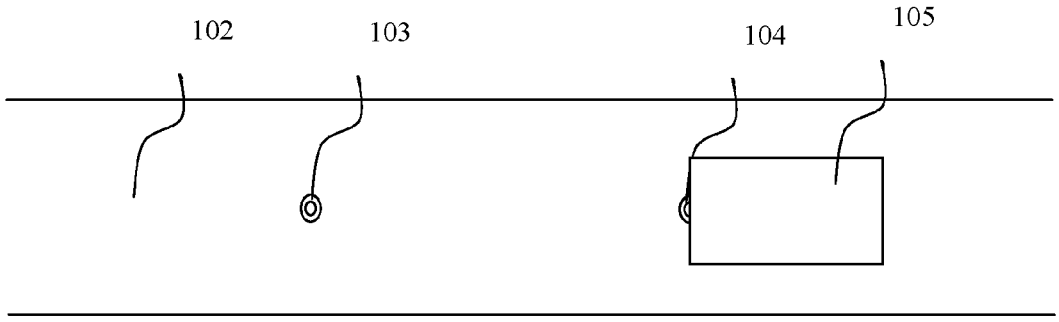
FIG. 6 is a state diagram of a front end of a banknote triggering a current sensor.

As shown in FIG. 6, a front end of the banknote 105 triggers the current sensor 104. In this case, the sensor 104 collects feature information of the banknote 105 to obtain a serial number and length information of the banknote, and a banknote jam threshold calculation unit calculates a banknote jam threshold M based on the length L of the banknote, i.e., M=k*L.

Figure 7:
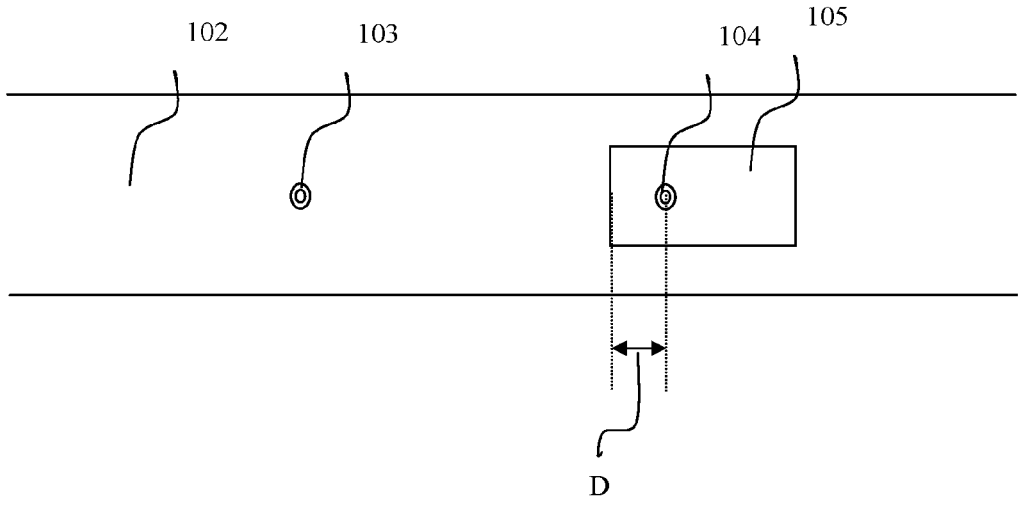
FIG. 7 is a state diagram of a banknote blocking a current sensor.
Figure 8:
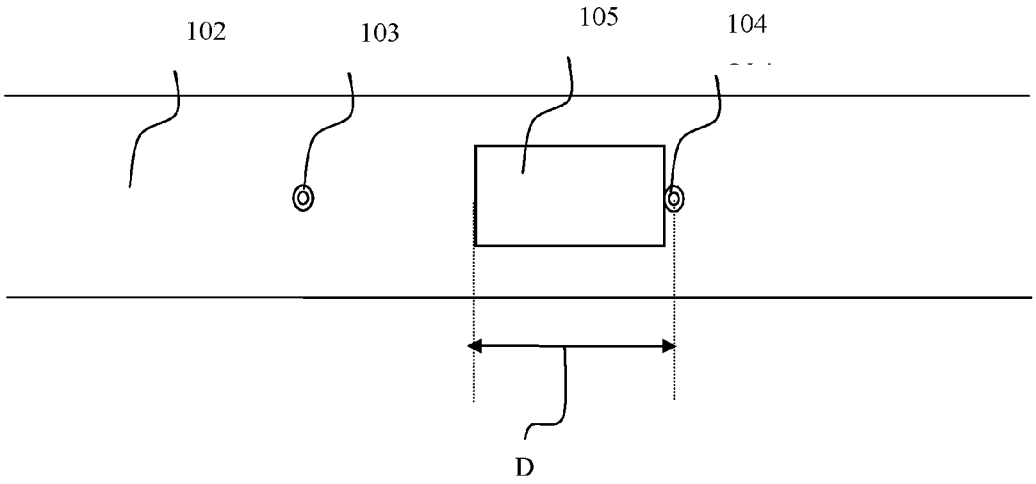
FIG. 8 is a state diagram of a rear end of a banknote which has left a current sensor.

As shown in FIG. 7, as the banknote 105 moves forward in the conveying direction, the banknote 105 gradually blocks the sensor 104, the sensor 104 continuously collects a distance D between the front end of the banknote 105 and the sensor 104, and a banknote jam determination unit 104 continuously determines whether D is greater than M, where M=k*L. If D>M, it is determined that there is a banknote jam, the banknote jam determination is ended, and subsequent conveying of the banknote is stopped. If D is not greater than the banknote jam threshold M, conveying of the banknote 105 continues, until a rear end of the banknote 105 has completely left the sensor 104 and the banknote 105 is in a state of not blocking the sensor 104, as shown in FIG. 8. In this case, the banknote jam threshold calculation unit 103 calculates the banknote jam threshold M again but according to M=k*(S−L)+L.

Figure 9:
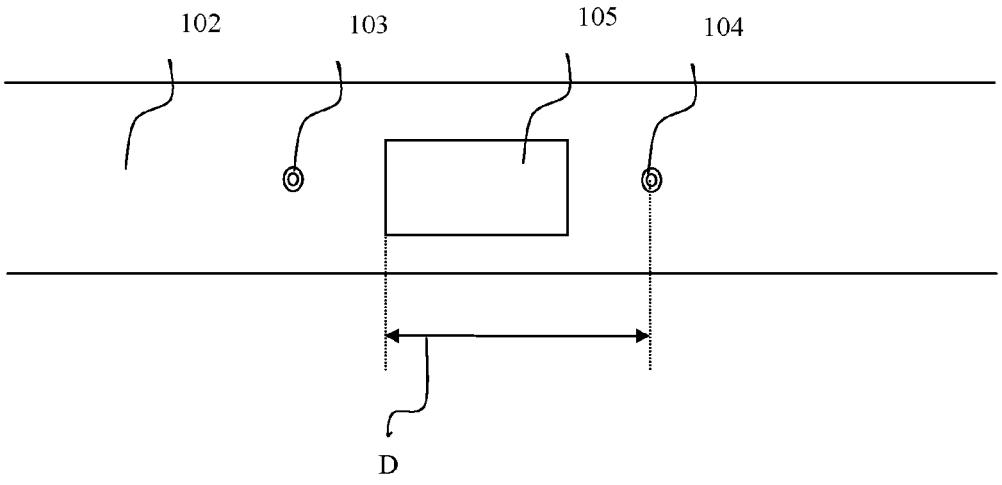
FIG. 9 is a state diagram of a banknote which has left a current sensor but not yet triggered a next sensor.
Figure 10:
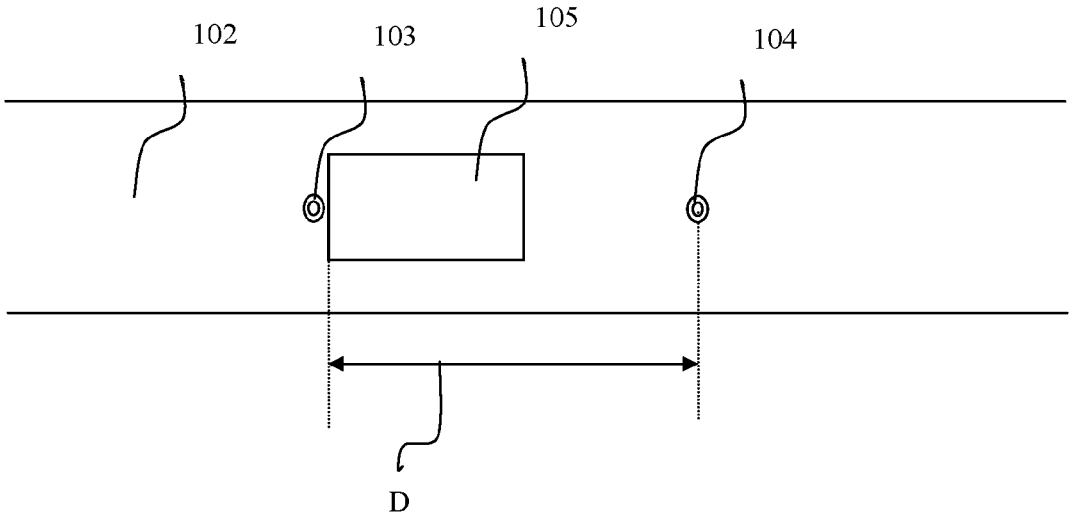
FIG. 10 is a state diagram of a front end of a banknote triggering a next sensor.

As shown in FIG. 9, as the banknote 105 is being conveyed, the distance D between the front end of the banknote 105 and the sensor 104 continuously increases, the sensor 104 continuously collects the distance D between the front end of the banknote 105 and the sensor 104, and the banknote jam determination unit 104 continuously determines whether D is greater than M, where M=k*(S−L)+L. If D>M, it is determined that there is a banknote jam, the banknote jam determination is ended, and subsequent conveying of the banknote is stopped. If D is not greater than the banknote jam threshold M, conveying of the banknote 105 continues, until the front end of the banknote 105 triggers the next sensor 103, as shown in FIG. 10. In this case, the banknote jam determination at the sensor 104 is stopped, and banknote jam determination at the sensor 103 is started.

That is, when the banknote 105 reaches the sensor 103, the front end of the banknote 105 triggers the sensor 103, the method for determining a banknote jam is updated to banknote jam determination for the banknote 105 with respect to the sensor 103, and step 3 of the method flow is entered, from which the banknote jam determination for the banknote 105 with respect to the sensor 103 starts. When the banknote 105 completely passes the entire banknote conveying passage 102, a complete process of the banknote jam determination for the banknote 105 with respect to the sensors is finished. The process proceeds in an arrangement sequence of as the sensors, and is thus sequential.

In addition, when banknote jam determination is performed for the banknote 105 with respect to the sensor 104, not only may banknote jam determination for another banknote with respect to the sensor 104 occur, but banknote jam determination for the banknote 105 with respect to another sensor may also occur. They are independently and simultaneously performed, based on banknote jam thresholds M corresponding to serial numbers of respective banknotes and distances D corresponding to respective sensors, without mutual interference. That is, the length L of the banknote in the formula for the banknote jam threshold varies with the banknote, and the distance D between adjacent sensors varies with the sensor. Further, when the banknote jam determination is performed for the banknote 105 with respect to the sensor 104, banknote jam determination for another banknote with respect to another sensor may occur, and they are independently performed. That is, D in the formula for the banknote jam threshold varies with the sensor, and is related to a physical location of the sensor on the conveying passage.

The banknote jam threshold varies with the serial number (including length information) of the banknote and a serial number of the sensor in a real-time manner. D in the formula for the banknote jam threshold is also bound with the serial number of the banknote and the serial number of the sensor, which refers to a distance between a specific banknote and a specific sensor. The formula for the banknote jam threshold may be changed into a general formula D>M=f(L,S). D is the distance between the front end of the banknote and the current sensor, and changes as the process of conveying the banknote. M is the banknote jam threshold. L is the length of the banknote, and varies with the type of the banknote. S is the distance between two adjacent sensors, and varies with locations of the two adjacent sensors. M is a function of L and S, and a value of M changes along with L and/or S. In conclusion, the method for determining a banknote jam according to the embodiment is a technology for dynamically determining a banknote jam in which the threshold varies with the banknote and the sensor.

The above descriptions only list some preferred embodiments of the invention and are not intended to limit the protection scope of the present disclosure. Equivalents made based on the specification and the drawings of the present disclosure shall fall within the protection scope of the present disclosure.

The invention claimed is:

1. A system for determining a banknote jam, comprising:

a sensor unit comprising a plurality of sensors arranged on a banknote conveying passage at a predetermined interval in a banknote conveying direction, wherein each of the plurality of sensors is configured to independently detect whether a banknote has arrived or left, collect feature information of the banknote which has arrived, and measure a distance between a front end of the banknote which has arrived and itself until the front end of the banknote reaches a next sensor;

a banknote information storage unit configured to store a length L and a serial number N of the banknote in a one-to-one correspondence manner and a distance S between each two adjacent sensors;

a banknote jam threshold calculation unit configured to calculate a banknote jam threshold M in a real-time manner, wherein the banknote jam threshold is M=k*L in a process from the front end of the banknote reaching a sensor to a rear end of the banknote leaving the sensor, the banknote jam threshold is M=k*(S−L)+L in a process from the rear end of the banknote leaving the sensor to the front end of the banknote reaching a next sensor, k is a constant, and S is the distance between the sensor and the sensor next to it; and a banknote jam status determination unit configured to determine whether a distance D between the front end of the current banknote and the current sensor is greater than the current banknote jam threshold M, determine that there is a banknote jam in a case that D is greater than M, otherwise determine that there is no banknote jam.

2. The system for determining a banknote jam according to claim 1, wherein the feature information of the banknote collected by the sensor unit comprises: the length L of the banknote and the serial number N of the banknote which can be directly identified by the system for determining a banknote jam, and a denomination of the banknote and other image feature information which can not be directly identified by the system for determining a banknote jam.

3. The system for determining a banknote jam according to claim 2, further comprising a banknote information processing unit configured to convert the denomination of the banknote and other image feature information which can not be directly identified by the system for determining a banknote jam, into the length L of the banknote and the serial number N of the banknote which can be directly identified by the system.

4. The system for determining a banknote jam according to claim 1, wherein k in the formula for the banknote jam threshold ranges from 1.1 to 2 and is determined by factors comprising speed stability of the banknote conveying passage and the length L of the banknote, the higher the speed stability of the banknote conveying passage is, the smaller k is, and the greater the length L of the banknote is, the smaller k is.

5. A method for determining a banknote jam for a system comprising a plurality of sensors, a banknote information storage unit, a banknote jam threshold calculation unit, and a banknote jam status determination unit, wherein the plurality of sensors are arranged on a banknote conveying passage at a predetermined interval in a banknote conveying direction, and each of the plurality of sensors is configured to detect independently in a banknote conveying process, an arriving status or a leaving status of a banknote;

wherein the method comprises:

step 1, detecting, by a sensor of the plurality of sensors, whether a banknote has arrived, by detecting whether a front end of the banknote triggers the sensor, going to step 2 in a case that the front end of the banknote triggers the sensor;

step 2, collecting, by the triggered sensor, feature information of the banknote, obtaining, by the banknote jam threshold calculation unit, a length L of the banknote from the banknote information storage unit based on the feature information of the banknote, and calculating, by the banknote jam threshold calculation unit, a banknote jam threshold M based on the length L of the banknote, wherein M=k*L, and k is a constant;

step 3, measuring, by the triggered sensor, a distance D between the front end of the banknote and the triggered sensor;

step 4, determining, by the banknote jam status determination unit, whether the distance D between the front end of the banknote and the triggered sensor is greater than the banknote jam threshold M, wherein M=k*L, going to step 9 in a case that D is greater than M, otherwise going to step 5;

step 5, detecting, by the triggered sensor, whether the banknote has left, by detecting whether a rear end of the banknote has left the triggered sensor, going to step 6 in a case that the rear end of the banknote has left the triggered sensor, otherwise returning to step 3;

step 6, obtaining, by the triggered sensor, a distance S between the triggered sensor and a sensor next to the triggered sensor in the banknote conveying direction, and calculating, by the banknote jam threshold calculation unit again, the banknote jam threshold M but according to M=k*(S−L)+L;

step 7, measuring, by the triggered sensor, the distance D between the front end of the banknote and the triggered sensor;

step 8, determining, by the banknote jam status determination unit, whether the distance D between the front end of the banknote and the triggered sensor is greater than the banknote jam threshold M, wherein M=k*(S−L)+L, if so, going to step 9, and if not, going to step 10;

step 9, determining, by the banknote jam status determination unit, that there is a banknote jam, stopping, by the banknote jam status determination unit, conveying of the banknote, and ending, by the banknote jam status determination unit, banknote jam determination at the triggered sensor;

step 10, detecting, by the sensor next to the triggered sensor, whether the front end of the banknote triggers the sensor next to the triggered sensor in the banknote conveying direction, going to step 11 in a case that the front end of the banknote triggers the sensor next to the triggered sensor in the banknote conveying direction, otherwise returning to step 7;

step 11, determining, by the banknote jam status determination unit, that the banknote is smoothly conveyed and there is no banknote jam, continuing conveying the banknote, and starting banknote jam determination at the next sensor.

6. The method for determining a banknote jam according to claim 5, wherein the method for determining a banknote jam is performed at each of the plurality of sensors independently.

7. The method for determining a banknote jam according to claim 5, wherein in step 2, k ranges from 1.1 to 2 and is determined by factors comprising a stability degree of a speed of the banknote conveying passage and the length L of the banknote, the higher the stability degree of the speed of the banknote conveying passage is, the smaller k is, and the greater the length L of the banknote is, the smaller k is.

8. The method for determining a banknote jam according to claim 5, wherein in step 6, k ranges from 1.1 to 2 and is determined by factors comprising a stability degree of a speed of the banknote conveying passage and the length L of the banknote, the higher the stability degree of the speed of the banknote conveying passage is, the smaller k is, and the greater the length L of the banknote is, the smaller k is.

9. The method for determining a banknote jam according to claim 5, wherein in step 4 and step 8, a general formula for determining whether the banknote is jammed is D>M=f(L,S), wherein D is the distance between the front end of the banknote and the triggered sensor and D changes as the process of conveying the banknote proceeds, M is the banknote jam threshold, L is the length of the banknote and varies with the type of the banknote, S is the distance between two adjacent sensor sand varies with locations of the two adjacent sensors, M is a function of L and S, and a value of M changes along with L and/or S.

* * * * *